US007331201B2

(12) United States Patent
No et al.

(10) Patent No.: US 7,331,201 B2
(45) Date of Patent: Feb. 19, 2008

(54) CONTROL PANEL OF WASHING MACHINE

(75) Inventors: Yang Hwan No, Changwon-si (KR); Han Ki Cho, Changwon-si (KR); Seong Jin Cho, Changwon-si (KR)

(73) Assignee: LG Electronics Inc., Seoul (KR)

( * ) Notice: Subject to any disclaimer, the term of this patent is extended or adjusted under 35 U.S.C. 154(b) by 702 days.

(21) Appl. No.: 10/721,320

(22) Filed: Nov. 26, 2003

(65) Prior Publication Data

US 2004/0154649 A1 Aug. 12, 2004

(30) Foreign Application Priority Data

Nov. 29, 2002 (KR) ..... 10-2002-0075352

(51) Int. Cl.
*D06F 39/00* (2006.01)

(52) U.S. Cl. ..... 68/3 R; 68/12.27; 68/12.23; 200/332

(58) Field of Classification Search ..... 68/3 R
See application file for complete search history.

(56) References Cited

U.S. PATENT DOCUMENTS 4,431,884 A * 2/1984 Flumignan et al. ..... 200/462
4,977,298 A * 12/1990 Fujiyama ..... 200/5 A
5,017,747 A * 5/1991 Nagahara et al. ..... 200/453

FOREIGN PATENT DOCUMENTS

| | | | |
|---|---|---|---|
| FR | 2581236 | * | 5/1985 |
| GB | 2178899 A | * | 12/1984 |
| KR | 2002-058542 A | * | 12/2000 |

* cited by examiner

*Primary Examiner*—Michael Barr
*Assistant Examiner*—Jason P. Riggleman
(74) *Attorney, Agent, or Firm*—Birch, Stewart, Kolasch & Birch, LLP

(57) ABSTRACT

A control panel of a washing machine is provided. The buttons of the washing machine on a display panel are disposed independent from corresponding switches on a display substrate. The control panel includes a frame provided on a cabinet to form an exterior, a display panel on a front side of the frame to have at least one button formed thereon, a display substrate in rear of the display panel to have at least one switch formed thereon, and a lever between the corresponding button and switch to operate the switch by receiving an external force applied to the button.

16 Claims, 8 Drawing Sheets

CONTROL PANEL OF WASHING MACHINE

This application claims the benefit of Korean Application (s) No. 10-2002-0075352 filed on Nov. 29, 2002, which is/are hereby incorporated by reference.

BACKGROUND OF THE INVENTION

1. Field of the Invention

The present invention relates to a washing machine, and more particularly, to a control panel of a washing machine, in which buttons on a display panel are disposed independent from corresponding switches on a display substrate.

2. Discussion of the Related Art

Generally, a washing machine performs washing, rinsing, and dewatering to eliminate dirt or filth attached to a laundry using interaction between water and detergent. And, such a washing machine belongs to one of a pulsator type, an agitator type, and a drum type.

A control panel is installed in the washing machine to control an operation of the washing machine.

FIG. 1 is a schematic cross-sectional view of a drum type washing machine according to a related art.

Referring to FIG. 1, in a drum type washing machine according to a related art, a cabinet 2 formed of a metal-based material forms an exterior. An entrance is formed at a front side of the cabinet 2, and a door 20 is installed at the entrance to prevent a laundry from popping out. And, a tub 6 supported by a spring 4 is installed in the cabinet 2 to hold water.

A drum 8 in which the laundry and detergent are put is rotatably installed in the tub 6. A rotational shaft 14 coupled with a motor 12 is installed in a rear side of the drum 8 to transfer a driving force to the drum 8. And, lifts 10 are installed on an inside of the drum 8 to pull up the laundry to fall.

Meanwhile, a gasket 22 formed of such an elastic material as rubber is installed between the door 20 and the tub 6. The gasket 22 alleviates a shock generated from a rotation of the drum 8 as well as makes the door 20 airtight to prevent the water from leaking.

A damper 16 is installed at one side under the tub 6. The damper 16 attenuates the vibration transferred to the tub 6 through the rotational shaft 14 while the washing machine operates.

Moreover, a water supply hose 28, a water supply valve, and a detergent box 32 are installed in an upper part of the cabinet 2 to supply the water and detergent to the tub 6. And, a drain pump 24 and a drain hose 26 are installed at one side under the tub 6 to circulate or discharge the water.

Meanwhile, a control panel 34, on which electronic parts for controlling an operation of the drum type washing machine are provided, is installed on a top of the cabinet 2. The control panel 34 is used for displaying an operational status of the drum type washing machine or controlling the operation of the washing machine by a user himself.

FIG. 2 is a perspective view of a control panel of a washing machine according to a related art, and FIG. 3 is a cross-sectional view of a control panel according to a related art.

Referring to FIG. 2 and FIG. 3, a control panel 34 according to a related art consists of a frame 35 on a cabinet 2, a display panel 38 on a front side of the frame 35, and a display substrate 42 in rear of the display panel 38.

A multitude of buttons 36 are provided on the display panel 38, and display parts (not shown in the drawing) for displaying an operational status of the washing machine and switches for controlling an operation of the washing machine are formed on the display substrate 42.

A button protrusion 44 protruding toward the display substrate 42 is formed beneath each of the buttons 36, and each of the switches 40 is provided under the corresponding button protrusion 44.

Hence, if the button 36 is pressed to go down, the corresponding switch 40 is brought contact with the button protrusion 44 to be turned on/off. A non-explained numeral '48' indicates a display window for displaying the operational status of the washing machine.

Meanwhile, various kinds of display windows and buttons are provided on the display panel as the size of the washing machine increases, whereby an arrangement area of the buttons increases as well.

However, since the switch is formed in rear of the corresponding button in the related art control panel, the display substrate is prepared to have a size similar to the button arrangement area.

Hence, as the size of the display substrate has to increase, so does the cost for preparing the display substrate.

Moreover, the buttons are formed thick in density on a predetermined area in case of downsizing the display substrate, whereby the locations of the buttons are limited.

SUMMARY OF THE INVENTION

Accordingly, the present invention is directed to a control panel of a washing machine that substantially obviates one or more of the problems due to limitations and disadvantages of the related art.

An object of the present invention, which has been devised to solve the foregoing problem, lies in providing a control panel of a washing machine, in which buttons on a display panel are disposed independent from corresponding switches on a display substrate.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a control panel of a washing machine according to the present invention includes a frame provided on a cabinet to form an exterior, a display panel on a front side of the frame to have at least one button formed thereon, a display substrate in rear of the display panel to have at least one switch formed thereon, and a lever between the corresponding button and switch to operate the switch by receiving an external force applied to the button.

In this case, the lever includes a first lever receiving the external force applied to the button to operate and a second lever coupled with the first lever to turn on/off the switch according to an operation of the first lever.

And, a rotational protrusion is formed at either the first lever or the second lever and a coupling recess is formed at either the second lever or the first lever so that the rotational protrusion is fitted to the coupling recess.

Moreover, the first and second levers are rotatably coupled with a backside of the display panel.

For this, lever fixing parts are formed at the backside of the display panel and the first and second levers are coupled with the corresponding lever fixing parts, respectively. Moreover, perforated holes are formed at the lever fixing parts and the first and second levers, respectively and lever rotational shafts are inserted in the corresponding perforated holes, respectively.

Meanwhile, an elastic member is provided between the display panel and the first or second lever to return the first and second levers to original state.

The elastic member is a plate spring. And, the elastic member may be zigzag-shaped.

And, a button protrusion is formed at a bottom of the button to be brought contact with the first lever once the external force is applied to the button. Instead, a protrusion can be formed at a top of the first lever to be brought contact with the first lever once the external force is applied to the button.

Meanwhile, a bent part is formed at a central portion of the second lever. And, a rib is provided at the bent part for rigidity reinforcement.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
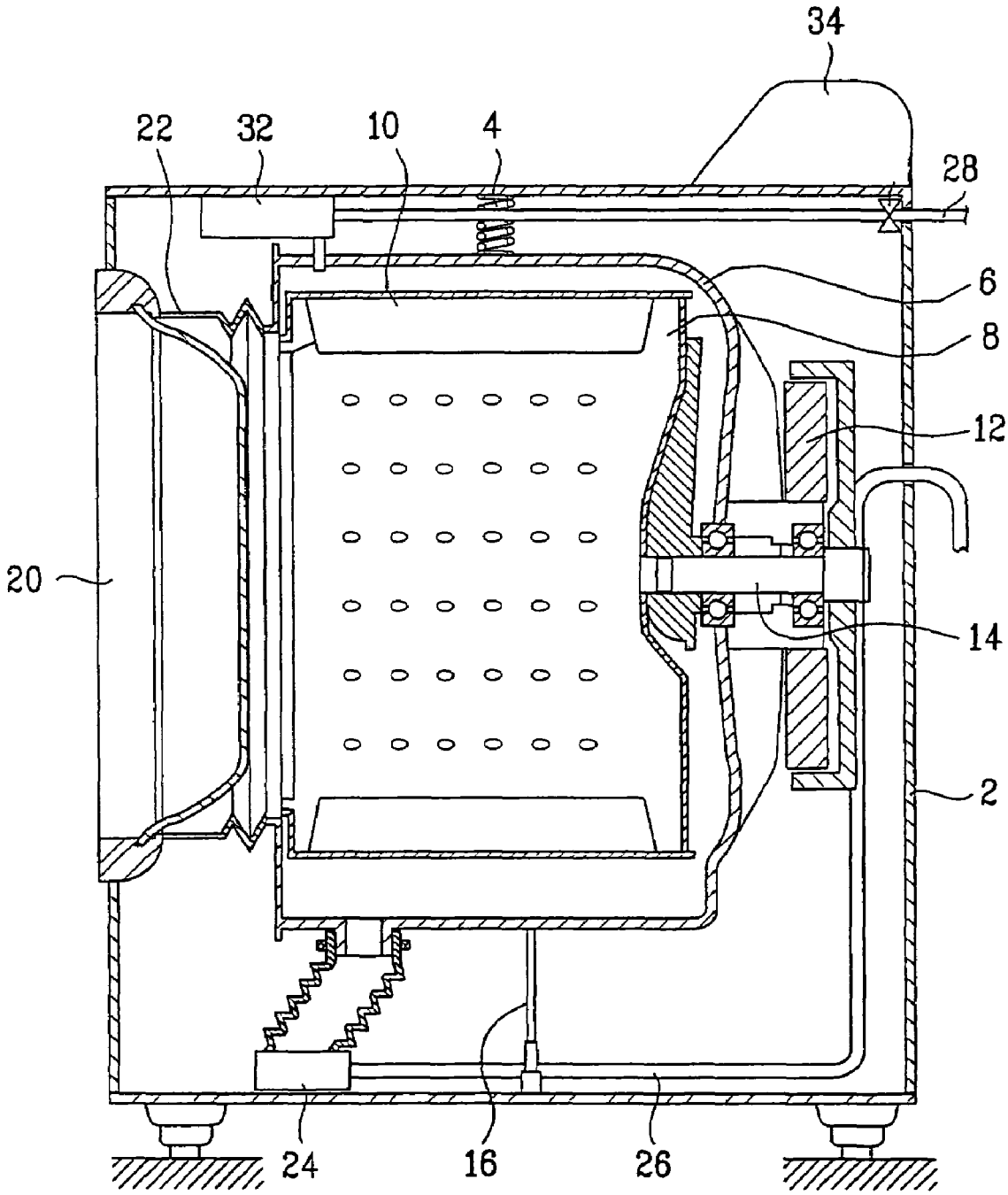
FIG. 1 Background Art
FIG. 1 is a schematic cross-sectional view of a drum type washing machine according to a related art.
Figure 2:
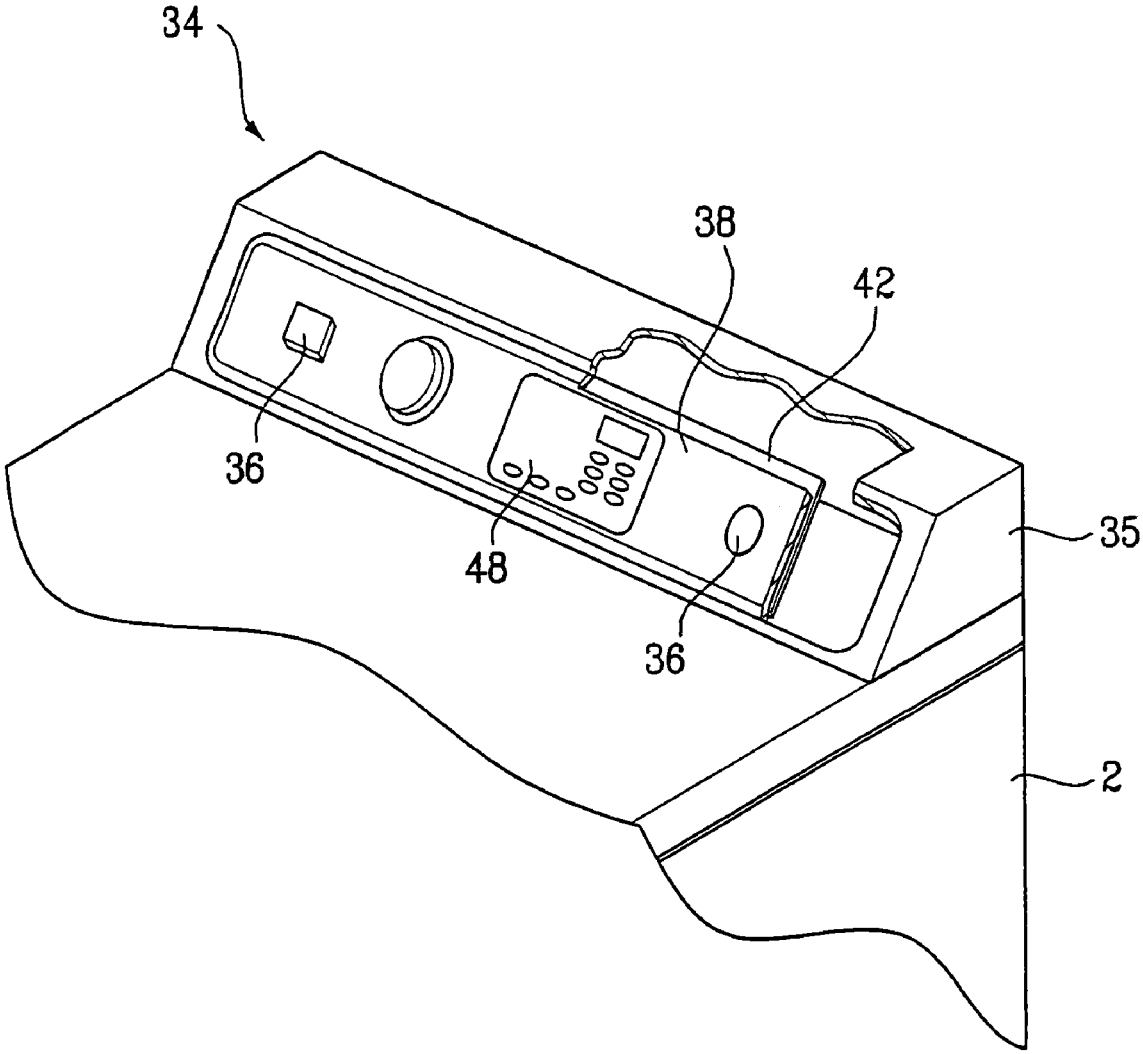
FIG. 2 Background Art
FIG. 2 is a perspective view of a control panel of a washing machine according to a related art.
Figure 3:
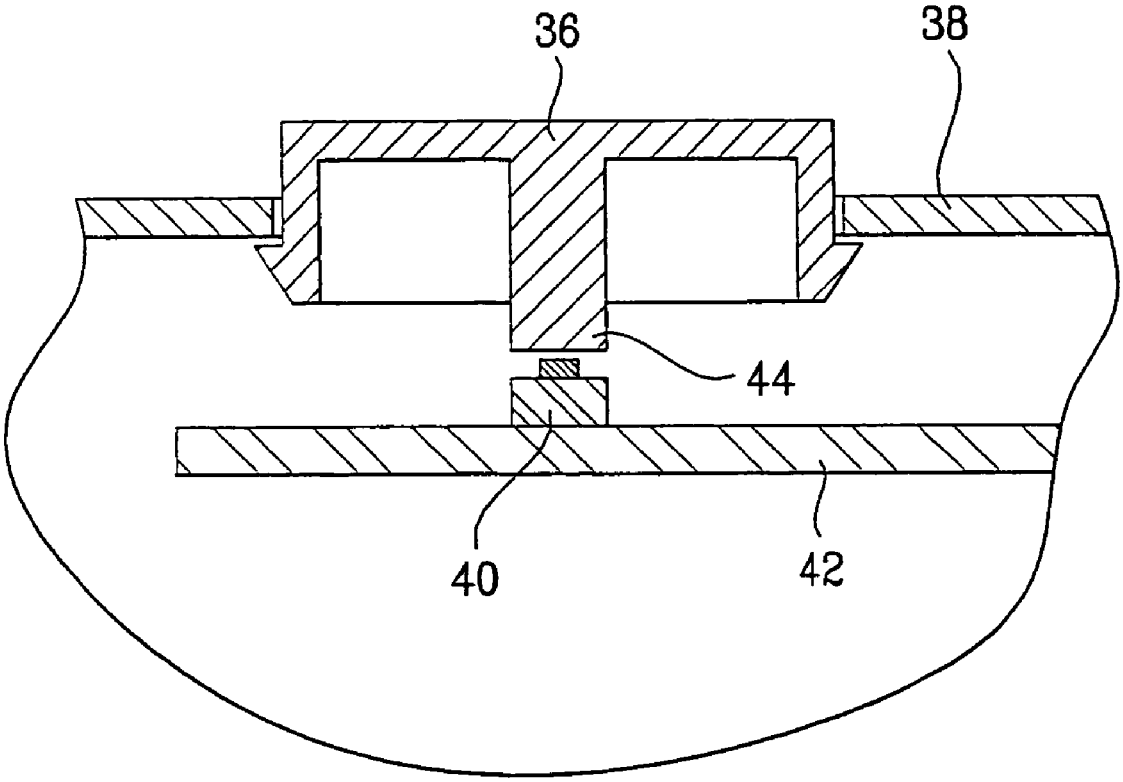
FIG. 3 Background Art
FIG. 3 is a cross-sectional view of a control panel according to a related art.
Figure 4:
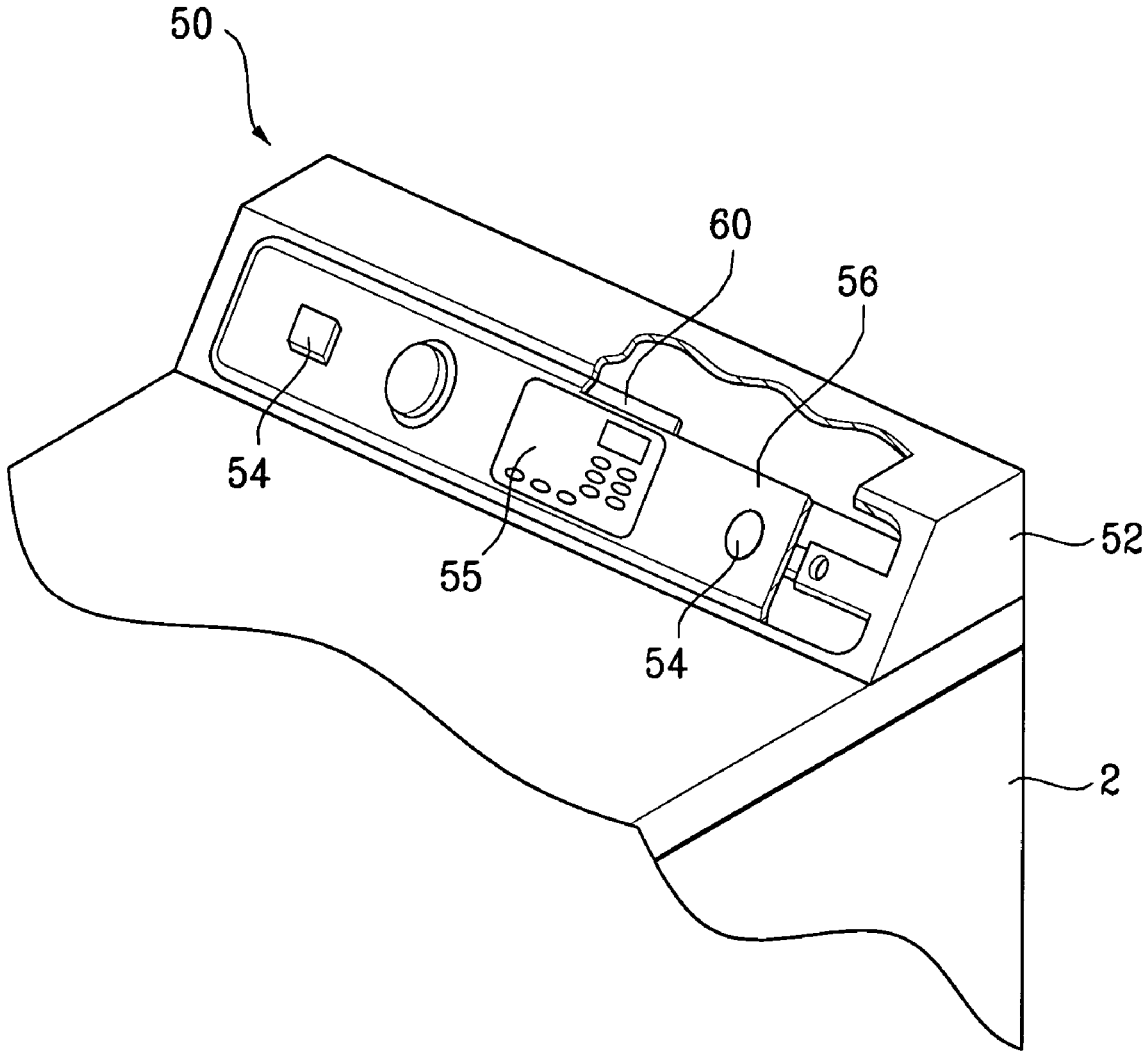
FIG. 4 is a perspective view of a control panel of a washing machine according to the present invention.

FIG. 4 is a perspective view of a control panel of a washing machine according to the present invention.

Referring to FIG. 4, a control panel 50 of a washing machine according to the present invention includes a frame 52 provided on a cabinet 2 to form an exterior, a display panel 56 installed on a front side of the frame 52, and a display substrate 60 provided in rear of the display panel 56.

A multitude of buttons 54 operated by a user and a display window 55 for displaying an operational status of the washing machine are formed on the display panel 56.

Figure 5:
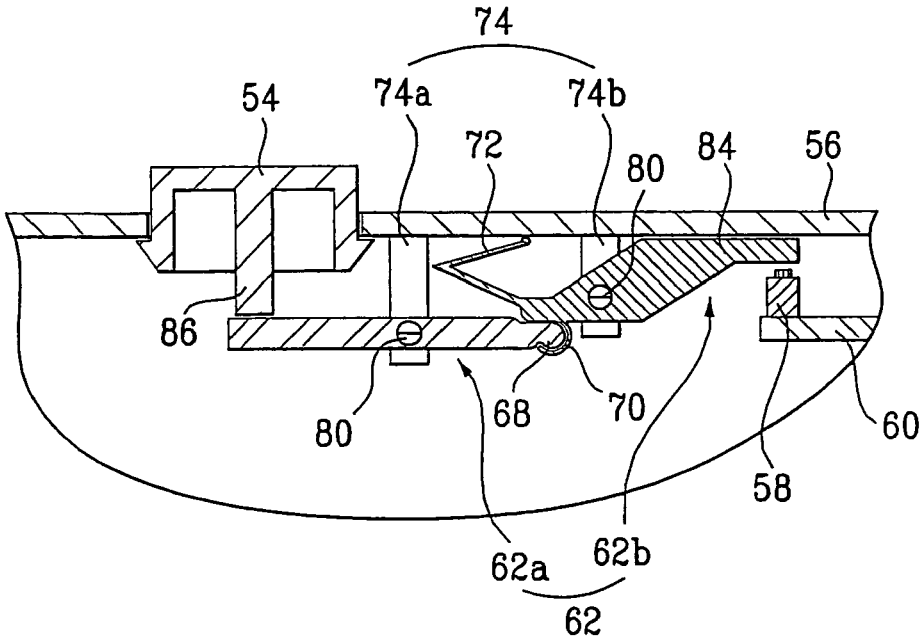
FIG. 5 and FIG. 6 are cross-sectional views of a control panel according to the present invention.
Figure 6:
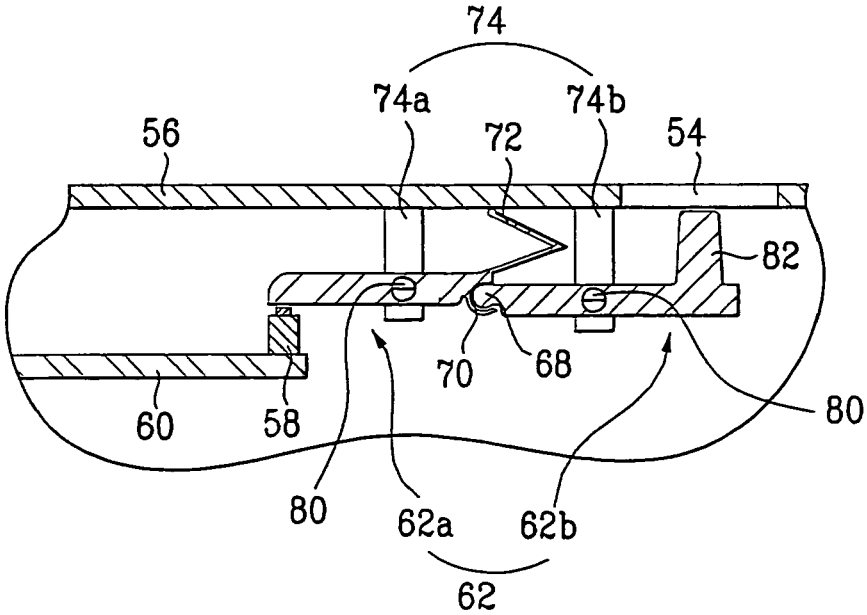
Figure 7:
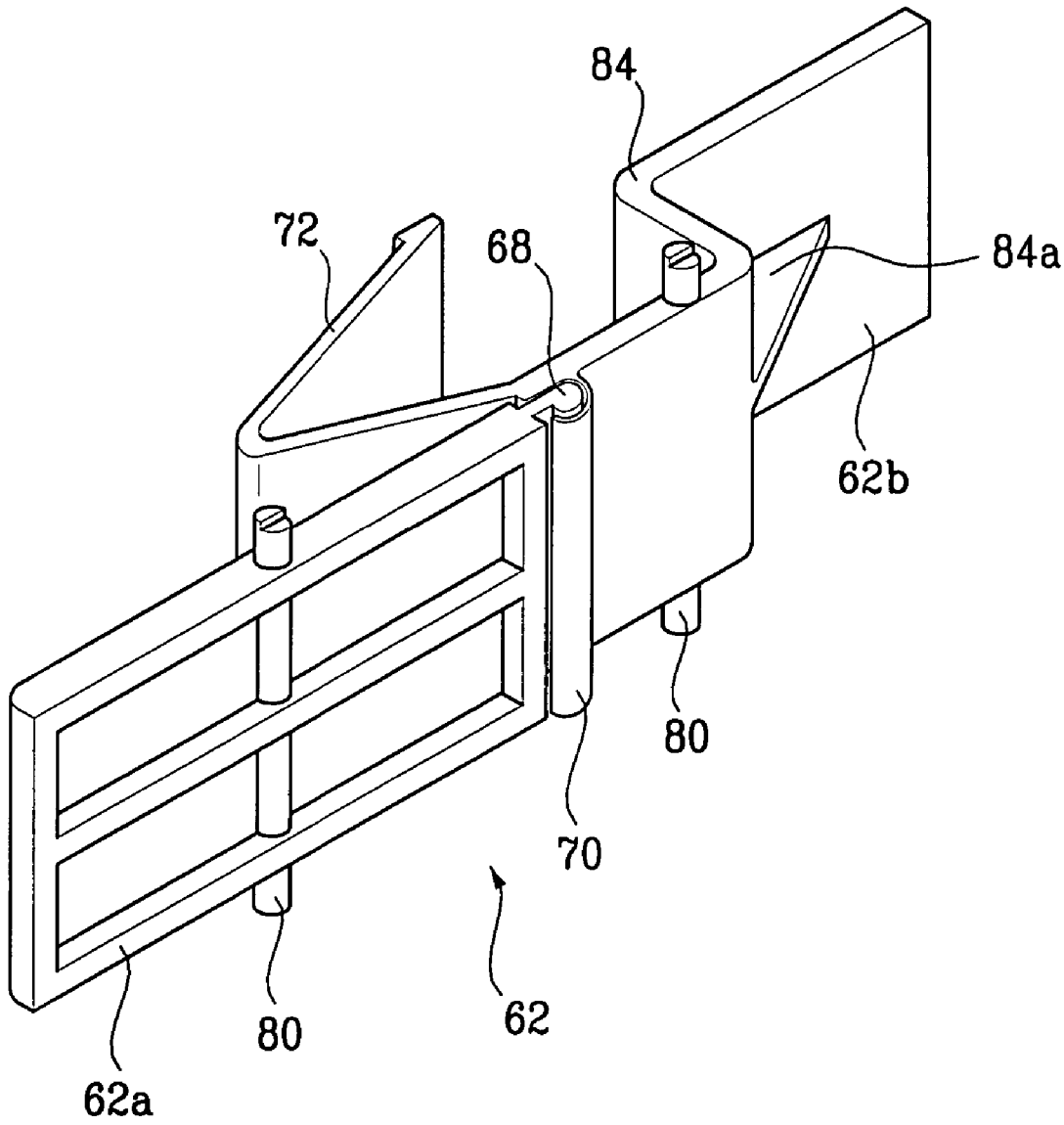
FIG. 7 and FIG. 8 are perspective views of a lever according to the present invention.
Figure 8:
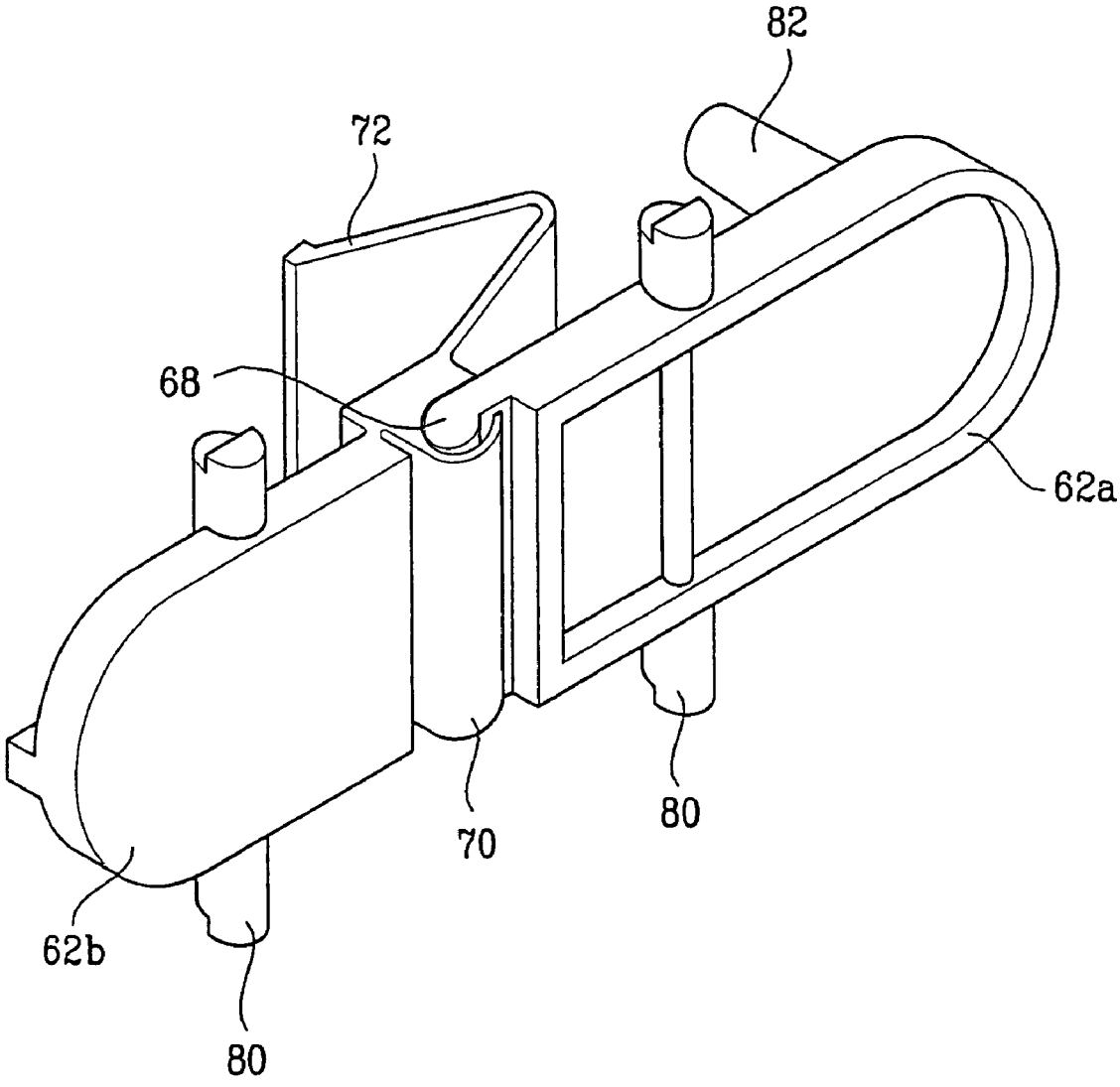

FIG. 5 and FIG. 6 are cross-sectional views of a control panel according to the present invention, and FIG. 7 and FIG. 8 are perspective views of a lever according to the present invention.

Referring to FIG. 5 and FIG. 6, a display part (not shown in the drawing) for displaying an operational status of the washing machine and at least one switch 58 for controlling an operation of the washing machine are formed on the display substrate 60.

In this case, a micro or snap switch is used as the switch 58 and LED or LCD is used as the display part. The display substrate 60 on which the switch 58 and the display part (not shown in the drawing) are integrated is formed smaller than the display panel 56.

Meanwhile, a lever 62 is provided between the button 54 and the switch 58 to operate the switch 58 by receiving an external force applied to the button 54.

The lever 62, as shown in FIGS. 5 to 8, includes a first lever 62*a* receiving the external force applied to the button 54 to operate and a second lever 62*b* connected to the first lever 62*a* to turn on/off the switch 58 according to an operation of the first lever 62*a*.

A rotational protrusion 68 is formed at one end of the first lever 62*a*, whereas a coupling recess 70 is formed at a corresponding portion of the second lever 62*b* to fit the rotational protrusion 68 therein. Hence, the first and second levers 62*a* and 62*b* are rotatably coupled with each other by the rotational protrusion 68 and the coupling recess 70. Of course, the rotational protrusion 68 and the coupling recess 70 can be formed at the second lever 62*b* and the first lever 62*a*, respectively.

And, the first and second levers 62*a* and 62*b* are rotatably coupled with a backside of the display panel 56.

For this, a lever fixing part 74 is provided at the backside of the display panel 56, and the first and second levers 62*a* and 62*b* are coupled with the lever fixing part 74.

Specifically, the lever fixing part 74 includes first and second fixing parts 74*a* and 74*b* provided between the button 54 and the switch 58 to leave a predetermined distance from each other.

A lever rotational shaft 80 is installed in each of the first and second levers 62*a* and 62*b*. The lever rotational shaft 80 is installed to penetrate both of the first lever fixing part 74*a* and the first lever 62*a* or both of the second lever fixing part 74*b* and the second lever 62*b*. For this, perforated holes are formed at both of the first lever fixing part 74*a* and the first lever 62*a* or both of the second lever fixing part 74*b* and the second lever 62*b*, respectively.

Hence, the first and second levers 62*a* and 62*b* are rotated by an external force applied to the button 54 centering on the lever rotational shafts 80, respectively.

Moreover, an elastic member 72 is provided at the first or second lever 62*a* or 62*b* to return the corresponding lever 62*a* or 62*b* to its original state once the external force applied to the button 54 is released.

The elastic member 72 having a zigzag shape is installed to be brought contact with the backside of the display panel 56. A plate spring is preferably used as the elastic member 72.

In order to facilitate to transfer the external force, which is applied to the button 54, to the lever 62, a button protrusion 86 is formed at a bottom of the button 54. The button protrusion 86 is brought contact with the first lever 62*a* when the button 54 is pressed by the external force.

Besides, in case that it is difficult to form the button protrusion 86 due to a shape or structure of the button 54, another protrusion 82 may be formed on the first lever 62*a* to be directly contacted with the button 54.

Meanwhile, a bent part 84 is formed at the second lever 62*b*. The bent part 84 is provided at a center of the second lever 62*b* to give a height difference between both ends of the second lever 62*b* if the second lever 62*b* is disposed at a position lower than that of the switch 58.

Hence, one end of the second lever 62*b* is located at a position lower than the switch 58, whereas the other end of the second lever 62*b* is disposed over the switch 58. And, a rib 84*a* is preferably provided at the bent part 84 for reinforcing rigidity thereof.

An operation of the above-constructed control panel according to the present invention is explained as follows.

Figure 9:
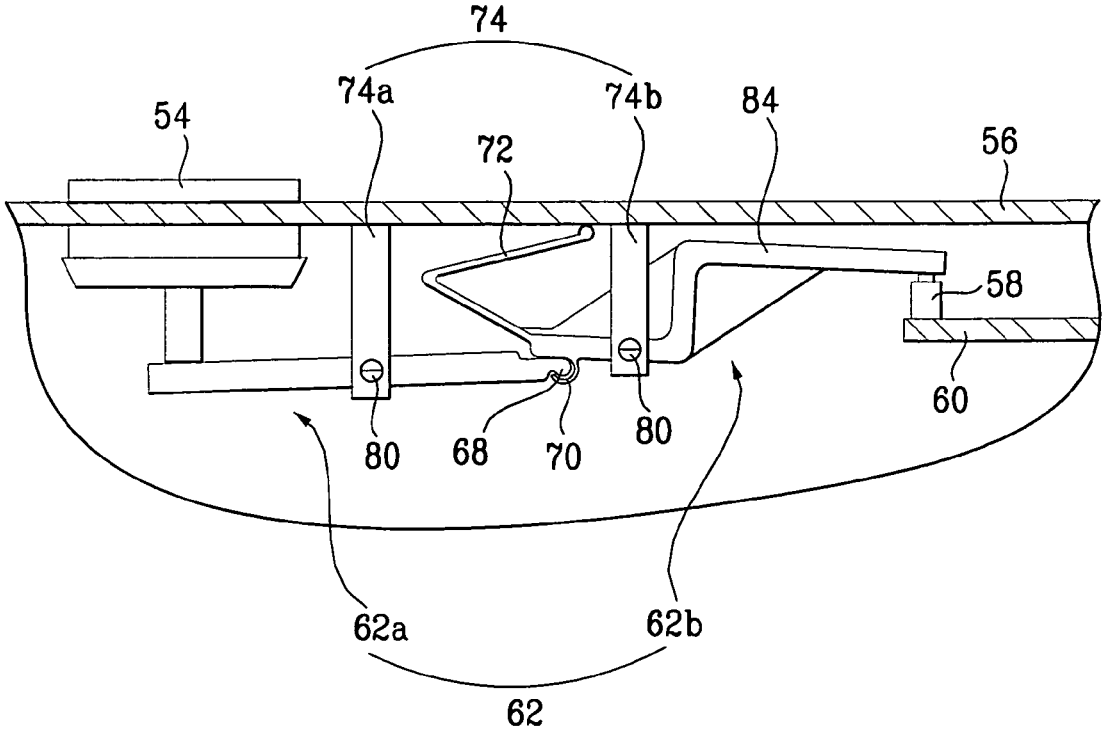
FIG. 9 and FIG. 10 are cross-sectional views for explaining an operation of a control panel according to the present invention.
Figure 10:
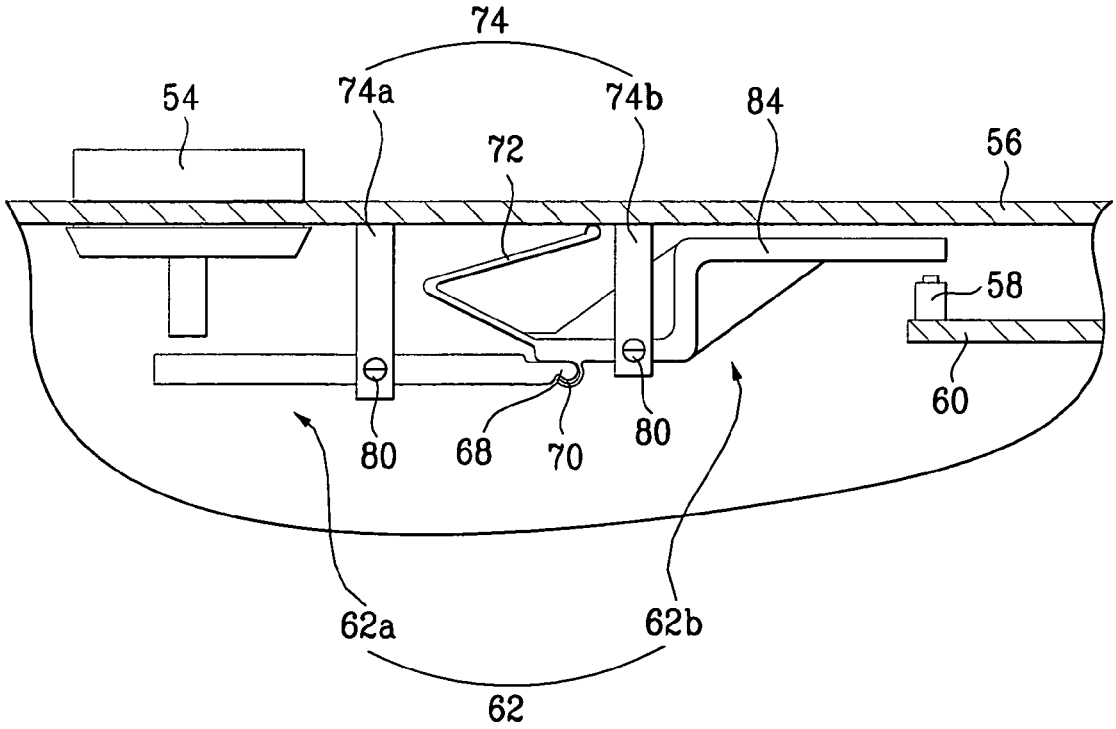

FIG. 9 and FIG. 10 are cross-sectional views for explaining an operation of a control panel according to the present invention.

Referring to FIG. 9 and FIG. 10, once a user presses the button 54, the button 54 comes into contact with the first lever 62*a* to push one end of the first lever 62*a* downward. Accordingly, the first lever 62*a* rotates centering around the lever rotational shaft 80 coupled with the first lever fixing part 74*a*.

In this case, the rotational protrusion 68 at the other end of the first lever 62*a* rotates in the coupling recess 70 at one end of the second lever 62*b* as soon as the other end of the first lever 62*a* moves toward the display panel 56 together with one end of the second lever 62*b*.

And, the second lever 62*b* rotates centering around the lever rotational shaft 80 coupled with the second lever fixing part 74*b* as well as soon as the other end of the second lever 62*b* rotates toward the display substrate 60 to press the switch 58.

Thereafter, when the button 54 is released, the lever 62 returns to its original state by the elastic member 74, and the other end of the second lever 62*b* is separated from the switch 58.

Therefore, whenever the user presses or releases the button 54, the switch 58 repeats to be turned on/off so as to operate/stop the operation controlled by the switch 58.

The above-described operation of the control panel 50 may be changed according to the locations and structures of the button 54 and the switch 58 as well as the shape and structure of the lever 62.

The control panel of the washing machine according to the present invention has the following advantages or effects.

First of all, the control panel according to the present invention utilizes the lever means for turning on/off the switch according to pressing/releasing the button, thereby facilitates to arrange the button for the switch.

Secondly, the control panel according to the present invention optimizes the switch on the display substrate regardless of the arrangement of the corresponding button, thereby enabling to downsize the display substrate. Therefore, the product cost of the display substrate is reduced as well.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A control panel of a washing machine, comprising:

a frame provided on a cabinet to form an exterior;

a display panel on a front side of the frame to have at least one button formed thereon;

a display substrate in rear of the display panel to have at least one switch formed thereon; and a lever structure between the corresponding button and switch to operate the switch by receiving an external force applied to the button, the lever structure including:

a first lever receiving the external force to rotate about a first non-movable pivot point; and a second lever coupled with the first lever, the second lever rotating about a second non-movable pivot point to turn on/off the switch when the first lever rotates, wherein the first non-movable pivot point is located at an intermediate portion of the first lever.

2. The control panel of the washing machine as claimed in claim 1, wherein the first and second levers are rotatably coupled with a backside of the display panel.

3. The control panel of the washing machine as claimed in claim 2, wherein lever fixing parts are formed at the backside of the display panel and the first and second levers are coupled with the corresponding lever fixing parts, respectively.

4. The control panel of the washing machine as claimed in claim 1, further comprising an elastic member located between the display panel and the lever structure, the elastic member being in contact with the display panel to provide a restoring force for the lever structure to return to an original state of the lever.

5. The control panel of the washing machine as claimed in claim 4, wherein the elastic member has a first end and a second end, the first end of the elastic member being in contact with the display panel, the second end of the elastic member extending from the second lever, the second non-movable pivot point being located between the second end of the elastic member and the switch.

6. The control panel of the washing machine as claimed in claim 5, wherein the elastic member is a plate spring.

7. The control panel of the washing machine as claimed in claim 5, wherein the elastic member is zigzag-shaped.

8. The control panel of the washing machine as claimed in claim 1, wherein a button protrusion is formed at a bottom of the button to be brought into contact with the first lever once the external force is applied to the button.

9. The control panel of the washing machine as claimed in claim 1, wherein a protrusion is formed at a top of the first lever to be brought into contact with the first lever once the external force is applied to the button.

10. The control panel of the washing machine as claimed in claim 1, wherein a bent part is formed at a central portion of the second lever.

11. The control panel of the washing machine as claimed in claim 10, wherein a rib is provided at the bent part for rigidity reinforcement.

12. The control panel of the washing machine as claimed in claim 1, wherein when the external force stops, the lever structure is spaced apart from the switch.

13. The control panel of the washing machine as claimed in claim 1, wherein the second non-movable pivot point is located at an intermediate portion of the second lever.

14. The control panel of the washing machine as claimed in claim 1, wherein the button is spaced apart from the lever structure when the external force applied to the button stops.

15. A control panel of a washing machine, comprising:

a frame provided on a cabinet to form an exterior;

a display panel on a front side of the frame to have at least one button formed thereon;

a display substrate in rear of the display panel to have at least one switch formed thereon; and a lever structure between the corresponding button and switch to operate the switch by receiving an external force applied to the button, the lever structure including:

a first lever receiving the external force to rotate about a first non-movable pivot point; and a second lever coupled with the first lever, the second lever rotating about a second non-movable pivot point to turn on/off the switch when the first lever rotates, wherein a rotational protrusion is formed at either the first lever or the second lever and a coupling recess is formed at either the second lever or the first lever so that the rotational protrusion is fitted to the coupling recess.

16. A control panel of a washing machine, comprising:

a frame provided on a cabinet to form an exterior;

a display panel on a front side of the frame to have at least one button formed thereon;

a display substrate in rear of the display panel to have at least one switch formed thereon; and a lever between the corresponding button and switch to operate the switch by receiving an external force applied to the button, wherein the lever comprises:

a first lever receiving the external force applied to the button to operate; and a second lever coupled with the first lever to turn on/off the switch according to an operation of the first lever, wherein the first and second levers are rotatably coupled with a backside of the display panel, wherein lever fixing parts are formed at the backside of the display panel and the first and second levers are coupled with the corresponding lever fixing parts, respectively, wherein perforated holes are formed at the lever fixing parts and the first and second levers, respectively and wherein lever rotational shafts are inserted in the corresponding perforated holes, respectively.

* * * * *